US011046490B2

(12) United States Patent
Cerveny

(10) Patent No.: US 11,046,490 B2
(45) Date of Patent: Jun. 29, 2021

(54) CONTAINER CAP COMPRISING TAMPER EVIDENCE MEANS

(71) Applicant: NESTEC S.A., Vevey (CH)

(72) Inventor: Jean-Paul Cerveny, Vittel (FR)

(73) Assignee: Societe des Produits Nestle S.A., Vevey (CH)

( * ) Notice: Subject to any disclaimer, the term of this patent is extended or adjusted under 35 U.S.C. 154(b) by 320 days.

(21) Appl. No.: 16/305,694

(22) PCT Filed: Jun. 2, 2017

(86) PCT No.: PCT/EP2017/063417
§ 371 (c)(1),
(2) Date: Nov. 29, 2018

(87) PCT Pub. No.: WO2017/211703
PCT Pub. Date: Dec. 14, 2017

(65) Prior Publication Data

US 2020/0324949 A1 Oct. 15, 2020

(30) Foreign Application Priority Data

Jun. 6, 2016 (EP) ..... 16173061

(51) Int. Cl.
*B65D 55/02* (2006.01)
*B65D 41/46* (2006.01)
(Continued)

(52) U.S. Cl.
CPC ..... *B65D 55/026* (2013.01); *B65D 41/46* (2013.01); *B65D 45/16* (2013.01); *B65D 55/12* (2013.01);
(Continued)

(58) Field of Classification Search
CPC ..... B65D 55/06; B65D 41/16; B65D 45/16; B65D 55/12; B65D 2401/00;
(Continued)

(56) References Cited

U.S. PATENT DOCUMENTS 2,486,364 A * 10/1949 Simmons ..... B65D 51/165 215/260
2,546,566 A * 3/1951 Schweizer ..... B65D 41/18 215/250
(Continued)

FOREIGN PATENT DOCUMENTS

CN 203064396 U 7/2013
DE 1911979 10/1970
(Continued)

*Primary Examiner* — J. Gregory Pickett
*Assistant Examiner* — Niki M Eloshway
(74) *Attorney, Agent, or Firm* — K&L Gates LLP

(57) ABSTRACT

A cap (100) for a container comprises a disc-shaped top section (102), an annular side section (104) projecting from said disc-shaped top section (102), and a locking flange (111) disposed at an extremity of said annular side section (104) opposite said disc-shaped top section (102), and further comprises a locking flap (116) extending from said annular side section (104), which is mobile between a locked first position wherein a portion (114) of the locking flange (111) extends inwardly from the annular side section (104), and an unlocked second position wherein the locking flange (111) is at least partially recessed relative to the annular side section (104). First tamper evidence means formed as partially frangible tab (120) and second tamper evidence means (128) are proposed. A package comprising a container and proposed cap (100) is also proposed.

14 Claims, 10 Drawing Sheets

(51) Int. Cl.
*B65D 45/16* (2006.01)
*B65D 55/12* (2006.01)

(52) U.S. Cl.
CPC ..... *B65D 2255/20* (2013.01); *B65D 2401/00* (2020.05)

(58) Field of Classification Search
CPC .. B65D 2255/20; B65D 45/20; B65D 1/0246; B65D 41/185
USPC ..... 215/203, 43, 250, 317
See application file for complete search history.

(56) References Cited

U.S. PATENT DOCUMENTS 3,603,473 A * 9/1971 Winberg ..... B65D 45/322 215/250
3,990,598 A * 11/1976 Zapp ..... B65D 41/185 215/272
4,376,493 A * 3/1983 Gall ..... B65D 45/20 220/784
4,564,116 A * 1/1986 Prohaska ..... B65D 41/44 215/256
4,632,271 A * 12/1986 Taylor ..... B65D 41/18 220/258.2
4,768,668 A * 9/1988 Van Den Brink ..... B65D 45/20 215/305
5,103,990 A * 4/1992 Irwin ..... B65D 41/525 215/212
6,082,567 A 7/2000 Bietzer et al.
7,611,027 B2 * 11/2009 Kim ..... B65D 41/48 215/305
8,955,712 B2 * 2/2015 Kloss ..... B44D 3/127 220/780
9,771,187 B2 * 9/2017 FitzSimons ..... B65D 47/06

FOREIGN PATENT DOCUMENTS

WO 2005021395 3/2005
WO 2014154255 10/2014

* cited by examiner

CONTAINER CAP COMPRISING TAMPER EVIDENCE MEANS

CROSS REFERENCE TO RELATED APPLICATIONS

The present application is a National Stage of International Application No. PCT/EP2017/063417, filed on Jun. 2, 2017, which claims priority to European Patent Application No. 16173061.9, filed on Jun. 6, 2016, the entire contents of which are being incorporated herein by reference.

FIELD OF THE INVENTION

The present invention concerns a cap for a container comprising tamper evidence means.

The invention also relates to a package comprising such cap.

BACKGROUND OF THE INVENTION

In the packaging arts, it is generally known to provide resealable closures on containers whose contents are not necessarily consumed all at once. They are used for packaging a wide variety of products, and are notably favoured for beverages and other comestibles.

A number of different kinds of resealable closures are known, for instance swinging lever closures, caps, and sliding push-pull closures. Among such closures, caps are regarded as particularly advantageous in that the consumer may open, re-seal, and re-open the container without the need of tools. Of these, the two types which command the overwhelming majority of market share are the press-on snap cap and the screw-on cap.

Screw-on caps are generally fabricated from a hard plastic or metal, and comprise internal threads which engage complementary threads disposed about the neck of the container. When screwed tightly to the container they provide a tight, leakage-resistant seal, and cannot be dislodged during normal use by external shocks and impacts as snap-caps can.

However, screw-on caps are less than ideal, in that they require a large amount of force to open and close. This poses difficulties to children, the elderly, and others who do not have sufficient strength or manual dexterity to properly tighten and loosen such a closure. Moreover, the provision of threads in the cap and on the neck of the container requires an increased level of precision in the manufacture of both relative to other types of closures, increasing the cost of the container.

Snap-caps, in contrast, are generally flat and fabricated from a flexible plastic, and typically comprise an annular groove disposed on a lower surface of the cap; this annular groove clasps a bead disposed about a mouth of the container; when attaching the cap the bead is pressed into the groove, causing the groove to open enough to permit the bead to seat therein.

At this point, the elasticity of the cap causes the groove to close around the seated bead, retaining the cap on the container. To open the container, the cap is merely grasped at one edge and bent upwards; the groove deforms to permit the bead to be extracted from the cap as it is removed from the container.

Such snap-caps are inexpensive to fabricate and require relatively little force to open and close. However, this also means that the strength of the joint between cap and container is weak. As a result, the cap may be easily dislodged when the cap or container are subjected to external shocks, small pressures and impacts (particularly from the lateral direction) that may be encountered during transport and use of the container, leading to leakage and spills. In addition, such snap-caps are usually provided with tamper evidence means generally made of a film or rigid material covering the cap and the neck of the container and which is not easily removable.

There is thus a need for a cap for a container which may be easily opened and closed, which is resilient to shock and impact, which is inexpensive to fabricate and implement and which comprises efficient and easy removable tamper evidence means. It is therefore an object of the invention to provide a closure which presents at least some of these attributes.

SUMMARY OF THE INVENTION

According, therefore, to a first aspect, there is provided a cap for a container, according to claim 1. Said cap comprises a disc-shaped top section extending generally in a horizontal plane, an annular side section projecting substantially perpendicularly from the perimeter of said disc-shaped top section along a vertical axis to an extremity defining a rim portion, a locking flange disposed at an extremity of said annular side section opposite said disc-shaped top section and comprising an immobile portion and a mobile portion, and a locking flap extending from at least a portion of the rim portion of said annular side section and being mobile between,

- a locked first position wherein the mobile portion of said locking flange contiguous with said locking flap extends inwardly from an interior face of said annular side section, and
- an unlocked second position in which said mobile portion of said locking flange is at least partially recessed relative to said interior face of said annular side section.

According to the invention, the cap further comprises first tamper evident means comprising a tamper evidence member attached to the annular side section and to the locking flap, said locking flap being thereby immobilized in the locked first position when the tamper evidence is in place defining thereby its functional position, in which the tamper evident member is partially frangible when the cap is first opened leading the locking flap to reach the unlocked second position so that the tamper evidence member remains attached to one of annular side section or locking flap after the cap is first opened.

This is advantageous in that the cap may be securely attached to a container simply by putting the locking flap in the first position. Since disposing the locking flap places the locking flange in a position where it projects inwardly from the annular side section of the cap, when the cap is disposed on a container it will engage and lock to an undercut near the mouth of the container, in the form of a suitably-dimensioned a rim or channel in the neck of the container. In this way, a seal is created between the cap and the container.

Conversely, when the locking flap is moved into the second unlocked position, the locking flange is disposed exterior to the imaginary surface formed by the extension of the interior face of the annular side. In other words, when the locking flap is disposed in the unlocked second position, the locking flange is displaced into a position where it will not engage the container and prevent the cap from being removed therefrom.

This is also advantageous in that since the locking flap extends from the extremity of the annular side section of the cap where the locking flange is also disposed, the locking flap forms a lever whose deflection moves the locking flange between the locked first position and the unlocked second position. The locking flap will thus multiply the force applied to it by the user, permitting a greater sealing and retaining force to be realized between the cap and the container than would be possible by a simple snap-on operation. The cap is thereby rendered resistant to being inadvertently removed.

Conversely, for a given sealing force the amount of force that must be applied by the user to open and close the container is greatly reduced, facilitating the use of the container by those who would otherwise have difficulty manipulating the closure means known in the art.

In addition, the proposed tamper evidence member integrated to the proposed snap-cap adds new functionalities to the cap. Indeed, it is necessary to displace the tamper evidence member from either one of annular side section or locking flap of the cap to displace the locking flap from the locked first position into the unlocked second position. Damage to the partially frangible tamper evidence member will indicate to the consumer that the container has been tampered with. With the proposed solution, the consumer can easily see if the cap has already been opened or not.

Furthermore, since the partially frangible tab immobilizes the locking flap, the tab will serve to prevent the locking flap from moving and the cap from being dislodged when the locking flap is inadvertently subjected to impact or abrasion prior to use, such as during transport or storage.

Moreover, as the partially frangible tab is an integral part of the cap, there is no need to provide any separate tamper-evident devices with the container, nor implement any particular machine or apparatus in the production line for its implementation.

In addition, as the tamper evidence member is only partially frangible, it will remain attached to the cap to either one of annular side section or locking flap and spreading it into the nature will be avoided.

In a preferred embodiment, the tamper evident member is a partially frangible tab.

This is advantageous in that the partially frangible tab can be easily manipulated by the user. As a result, both the tab and the cap can be removed with one hand. Thus while the consumer is holding the container with one hand, with the other hand he can easily remove both the tab and the cap without any large amount of force or specific dexterity.

Preferably, the partially frangible tab comprises a first part attached to one of annular side section or locking flap that is frangible and a second part respectively attached to one of locking flap or annular side section that is not frangible.

This is advantageous in that tab is unavoidable as clearly visible by the consumer who can easily identified if the cap has already been manipulated.

In addition, the second part remains attached to one of locking flap or annular side section when the cap is first opened leading the locking flap to reach the unlocked second position.

In the proposed embodiments, the tab is located on the main parting line of the injection mould so that the injection is easy reliable and accurate for making frangible parts like bridges on different locations of the tab.

In a preferred embodiment, the tab forming the first tamper evidence means is integral with the annular side section. The whole cap can then be produced in one time integrating said first tamper evidence means.

In another preferred embodiment, the first part of the tab that is frangible comprises at least one frangible bridge attached to the locking flap.

The use of frangible bridges is particularly advantageous in that they can be broken without any large amount of force using only one finger while still allowing a secure connection avoid inadvertent rupture.

In a particularly interesting embodiment, the second part of the tab that is not frangible is connected to the annular side section by a hinge.

This allows the tab to remain connected to annular side section of the cap and not to be completely detached from the cap. The loss of the tab into the nature is then avoided which is a great advantage especially when the container is given to kids.

Thanks to this specific feature, the tab fades and lies against the annular side section. As the tab is faded, it does not anymore constitute a hitching point on which the consumer can hurt when he grips the container to open it again by manipulating the cap.

According to a second embodiment of the invention, the hinge of the tab forming the tamper evidence member is inclined with respect to the vertical axis defined as the direction of the annular side section projecting substantially perpendicularly from the perimeter of the disc-shaped top section.

The inclined hinge advantageously, avoid any interaction between the upper surface of tab and the locking flap when the locking flap is manipulated from the locked position to the unlocked position for the opening of the container.

Preferably, the hinge is inclined from 20 to 60° with respect to the vertical axis. This feature allows to have a trajectory of the lower part of the tab not interfering with the locking flap when it has to be moved from first locked position to second unlocked position.

The proposed cap is provided with notches located at the lateral intersection of the locking flap and the annular side section and according to the invention, the cap further comprises second tamper evidence means located between two opposite internal edges of the notches.

This specific location of the second tamper evidence means, at the mechanical frontier between the mobile portion of the locking flange and the non-mobile portion of the cap is particularly advantageous in that any change in the conformation of the notches will have an effect on these second tamper evidence means.

As a preferred solution, the second tamper evidence means comprises a connection conformed as a plastic bridge connection between two opposite internal edges of the notches. Said connections is conceived so as to break when the locking flap is moved from the first locked position to the second unlocked position.

As for the first tamper evidence means, the second tamper evidence means is integral with the cap.

Hence, these second tamper evidence means works independently from the first tamper evidence means so that it ensures for the end consumer a double security for checking if the container has already been opened.

The invention is also related to a package comprising a cap and a container, said container comprising a mouth provided with a neck having a shoulder, in which said cap is disposed upon the mouth of said container such that the locking flange of said cap engages the shoulder of the neck of the container.

Such a package is very comfortable for the consumer as he can drink directly through the neck of the container with no plastic part remaining attached to said neck. It configuration also allows to increase the hygiene of the neck.

According to additional features of the cap, the locking flap is bistably mobile between the locked first and unlocked second positions.

This is advantageous in that the locking flap is biased to move to and hold itself in either of the two positions. As a result, the locking flap is rendered more resistant to inadvertent deflection, while retaining a high ease of operation.

Preferably, the locking flap is bistably mobile about a centre position defined by a plane parallel with the disc-shaped top section and intersecting the extremity of the annular side section, such that it forms an oblique angle with the annular side section when said locking flap is disposed in the locked first position, and forms an acute angle with the annular side section when said locking flap is disposed in the unlocked second position.

This is advantageous in that the position of the flap relative to the rest of the cap gives an intuitive visual indicator of whether the cap is locked to the container. Specifically, when the flap is pointing "down," i.e. towards the container, the cap is locked to it; when the flap is pointing "up," i.e. away from the container, it is unlocked and may be removed from the container.

Furthermore, configuring the bistable motion of the flap in such a way is advantageous in that it naturally facilitates the manipulation of the locking flap between the locked first and the unlocked second positions. For instance, when moving the locking flap from the locked first into the unlocked second position when the container is normally oriented (i.e. with the neck pointing upwards), the user will pull on the locking flap in such a way as to also pull on the cap, thereby facilitating its separation from the container. Conversely, when moving the locking flap into the locked first from the unlocked second position, the user will press on the locking flap in such a way that the cap is pressed into the container, facilitating the motion of the locking flap and ameliorating the sealing that results. The use of the cap is thereby made more intuitive.

In one possible embodiment, the locking flap extends from the extremity of the annular side section along the entire perimeter of said extremity.

Such a cap will realize the greatest possible sealing force, in that the cap engages the container upon which it is used over its entire circumference.

In another possible embodiment, the locking flap extends from the extremity of the annular side section along a portion of the perimeter thereof, the locking flange being thereby divided into an immobile first portion and a mobile second portion contiguous with said locking flap.

This is advantageous in that, by restricting the locking flap to a portion of the annular side section, the force that is needed to displace the locking flap between the first and second positions is reduced. When working in combination with the immobile first portion of the locking flange, the mobile second portion will realize a closure force sufficient for many applications, while minimizing the force necessary to open and close the container.

Optionally, the immobile first portion of the locking flange extends from a segment of the annular side section comprising between 20° and 80°, inclusive, of the annular side section.

Optionally, the mobile second portion of the locking flange extends from a segment of the annular side section comprising between 20° and 80°, inclusive, of the circumference of said annular side section.

This is advantageous in that the reduced length of the immobile first and mobile second portions of the locking flange will reduce the cost of fabricating the cap and the effort required to attach and remove it, while maintaining a sealing force sufficient for many applications.

Preferably, the immobile first portion and the mobile second portion of the locking flange are disposed substantially symmetrically about the annular side section.

Most preferably, the immobile first portion is disposed directly opposite the mobile second portion.

This is advantageous in that the sealing force that is applied to the container by the locking flanges will be symmetrical about the axis of the container. The cap will therefore avoid any deformation of the container when the locking flap is placed in the locked second position, reducing in turn the possibility of leaks past the cap. The reliability of the cap is thereby improved.

Advantageously, the locking flap is a segment of a hollow conic frustum.

A locking flap in such a configuration is particularly desirable in that, for a cap with an overall cylindrical aspect, it minimizes the amount of material required to fabricate the cap, rendering it lighter and less expensive to produce. A conic section has the further advantage of being readily adaptable to the contours of curved containers, naturally sitting pressed against the exterior of the container when the locking flap is disposed in the locked first position. This obviates the need for plastic overwraps or other such additional packaging means to retain the locking flap in place.

Optionally, the cap further comprises a sealing ring projecting from the disc-shaped top section and disposed coaxially within the annular side section.

This is advantageous in that the sealing ring will come in contact with an interior surface of the container. As the neck of the container enters into an interference fit with the sealing ring and the annular side section, the sealing effectiveness of the cap is further improved.

Preferably, the sealing ring projects from the disc-shaped top section following an oval or elliptical curve.

This is advantageous in that the non-circular form of the sealing ring will serve to centre the cap upon the mouth of the container when the former is placed upon the latter with an angled or off-cantered orientation. The usability and reliability of the cap is thereby further improved.

In connection with the use of the specific claimed cap, there is provided a preform for the fabrication of a container, comprising a neck opening into a mouth at one extremity.

For complete correspondence between the claimed cap and the neck of the container that is fabricated, the preform leading to the container further comprises a shoulder disposed about said neck proximate to said mouth, said shoulder being configured to be engaged by a locking flange of a cap according to the preceding description.

This is advantageous in that a preform so configured, and a container fabricated from such a preform, will be ideally suited to accommodate a cap as described above and realize a tight, secure seal therewith.

The claimed cap is hence mounted on a container and used in a package comprising a container fabricated from a preform as described above, and a cap as described above, said cap being disposed upon the mouth of said container such that the locking flange of said cap engages the shoulder of the neck of said container.

Such a package is advantage in that it realizes the advantages of the cap described above in the form of a package that may be used for the distribution of products to end consumers.

BRIEF DESCRIPTION OF THE DRAWINGS

Additional features and advantages of the present invention are described in, and will be apparent from, the description of the present embodiments which are set out below with reference to the drawings in which.

DETAILED DESCRIPTION OF THE INVENTION

For a complete understanding of the present invention and the advantages thereof, reference is made to the following detailed description of the invention.

It should be appreciated that various embodiments of the present invention can be combined with other embodiments of the invention and are merely illustrative of specific ways to make and use the invention and do not limit the scope of the invention when taken into consideration with the claims and the following detailed description.

As used in this specification, the words "comprises," "comprising," and similar words, are not to be interpreted in an inclusive or exhaustive sense. In other words, they are intended to mean "including, but not limited to."

Furthermore, in the following description, it should be understood that terms used to express geometric or other such relations (e.g. "parallel") between components are considered as being substantive terms rather than exact ones, and that as a result the qualifier "substantially" is to be read into any such term unless stated otherwise.

The invention is further described with reference to the following examples. It will be appreciated that the invention as claimed is not intended to be limited in any way by these examples.

Figure 1A:
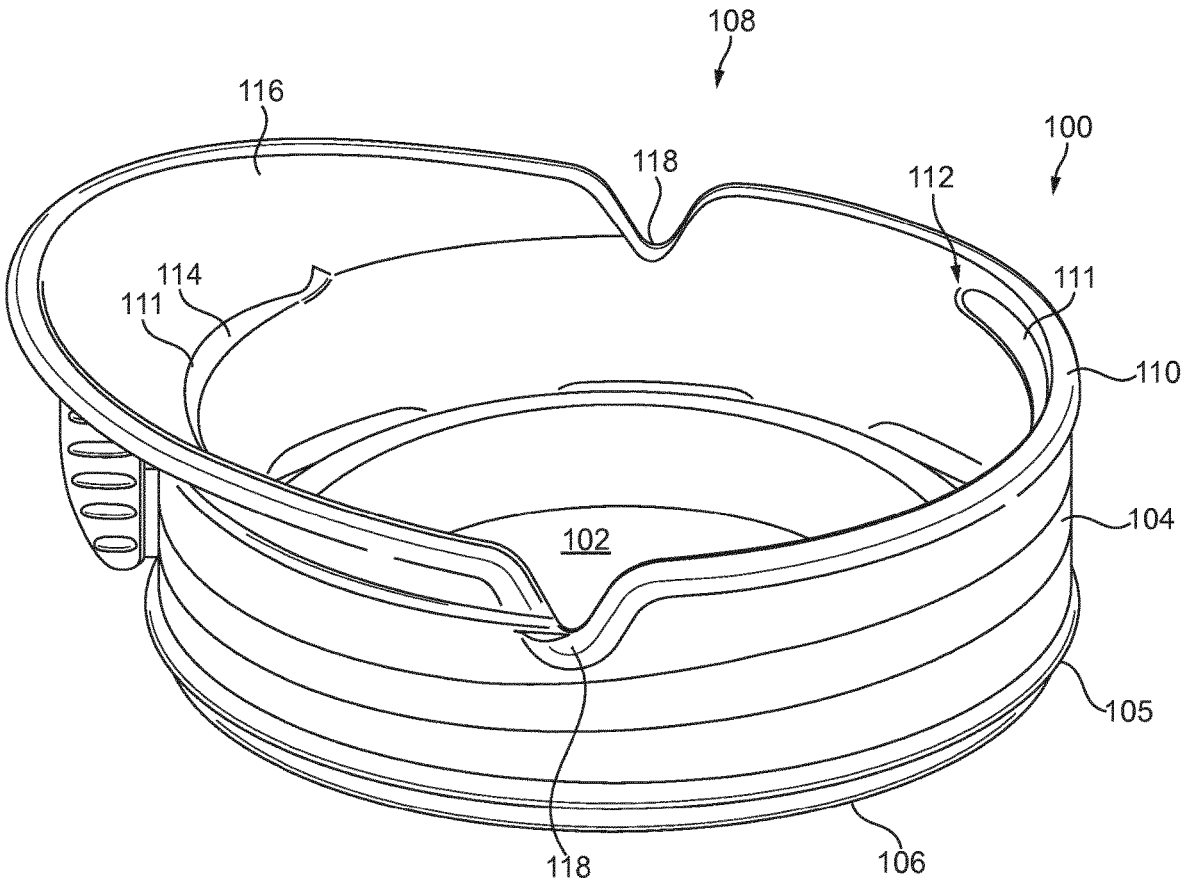
FIGS. 1A, 1B & 1C are respectively bottom perspective; top perspective and front views, of a cap according to a first embodiment of the invention in the first locked position.
Figure 1B:
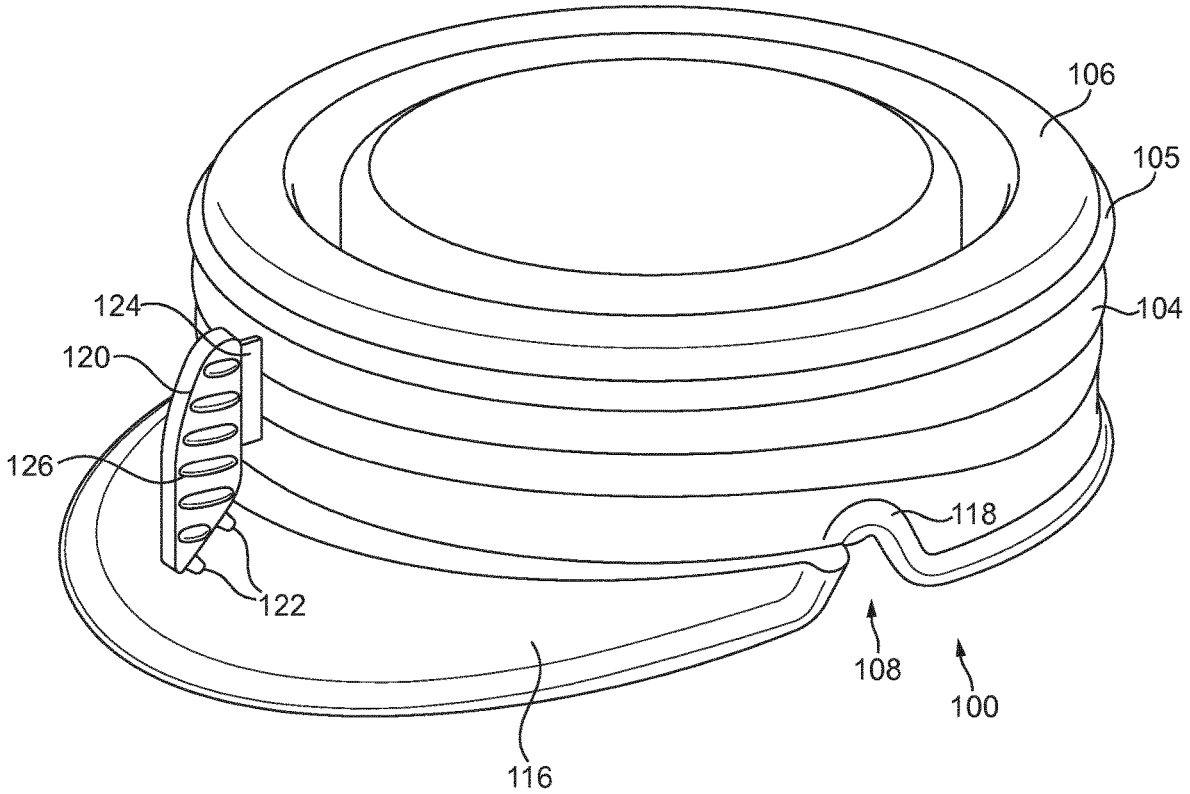
Figure 1C:
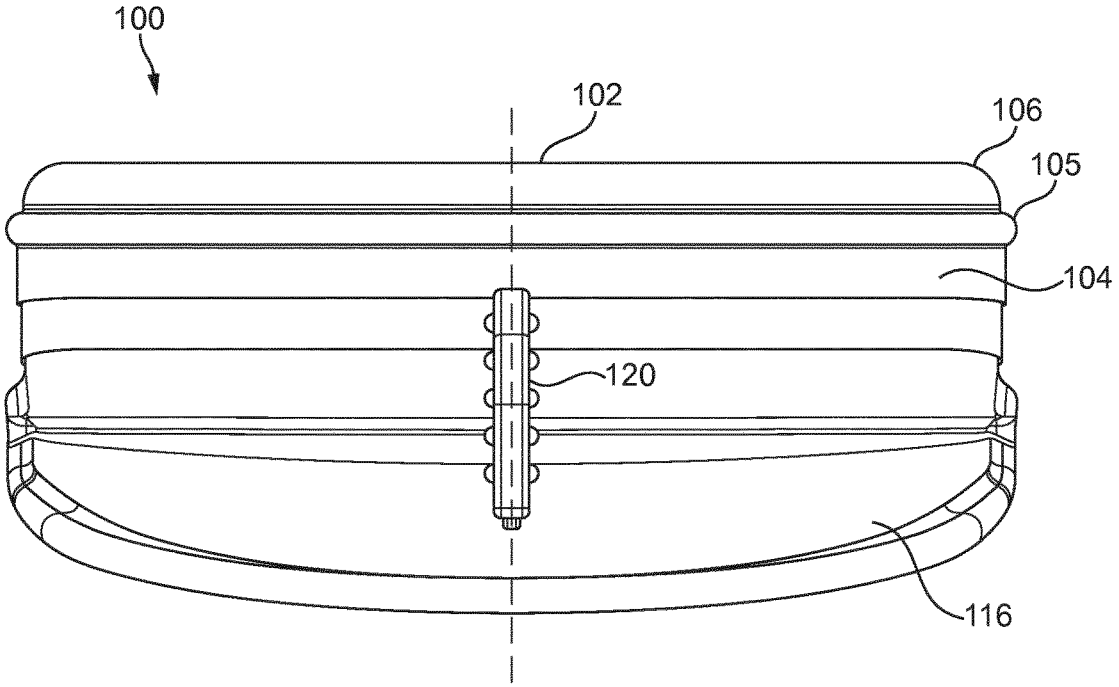

FIGS. 1A, 1B & 1C are respectively bottom perspective; top perspective and front views, of a cap according to a first embodiment of the invention. Of course, it will be understood that the cap depicted in FIGS. 1A to 1C is intended to be attached to a container, and as such for the purposes of this document orientative terms such as "top" and "bottom", "horizontal" and "vertical" shall be assumed to be as for a cap which is attached to an upright container.

In FIG. 1A, the cap 100 comprises globally a disc-shaped top section 102 and an annular side section 104. The annular side section 104 extends from the perimeter 106 of the disc-shaped top section 102 in a substantially perpendicular direction, with the result that the cap 100 is of a generally cylindrical form, with one open end 108 opposite the disc-shaped top section 102 which accommodates a neck of a container (not shown) to which the cap 100 is attached. The open end 108 is delimited by the rim 110 of the cap 100, said rim 110 constituting an extremity of the annular side section 104 opposite the disc-shaped top section 102.

As can be seen, the annular side section 104 presents progressive varying thickness (see the different circular lines on the annular side section 104). A specific annular portion 105 of the annular side section 104 is provided as gripping means in the process of capping the container with the cap 100. Thanks to the annular portion 105, the capping head of the bottling line is able to grip the cap and bring it above the container for the capping of said container.

The cap 100 is further provided with a locking flange 111, which is in this embodiment separated into the immobile portion 112 of the locking flange and a mobile portion 114 of the locking flange. The portions 112, 114 of the locking flange 111 engage a ridge or channel provided in a neck of a container to which they are attached, thereby retaining the cap thereupon and sealing the container.

The immobile portion 112 of the locking flange 111 is disposed upon a circumference of the annular side section 104 such that it is opposite the mobile portion 114 of the locking flange 111.

It should be noted that in certain embodiments such as this one, the several portions 112, 114 of the locking flange 111 may collectively extend over only a portion of the circumference of the annular side section 104; this may be done to economise on material and reduce the amount of force needed to attach the cap to the container. In such cases, the locking flange 111 is ideally configured such that the parts thereof are disposed along the circumference of the annular side section 104 in a symmetrical fashion, as is the case here with the immobile portion 112 and the mobile portion 114 of the locking flange 111.

Furthermore, in such embodiments it may be particularly advantageous to configure the locking flange such that each part thereof extends over a portion of the circumference of the annular side section comprising between 20° and 80° thereof; in the present embodiment, the immobile portion 112 and the mobile portion 114 of the locking flange 111 each extend over approximately 45° of the circumference of the annular side section 104.

It will be readily recognized, however, that in other embodiments the portions of the locking flange may extend over different, not necessarily identical or symmetrical, portions of the circumference of the annular side section, according to the particularities of the application in which that embodiment is to be employed.

The cap 100 is further provided with a locking flap 116, extending from a portion of the rim 110 of the cap 100. The locking flap 116 is substantially coincident with the mobile portion 114 of the locking flange in this embodiment, and mobile between a locked first position as depicted here, and an unlocked second position wherein the locking flap 116 is rotated towards the disc-shaped top section 102 about the portion of the rim 110 contiguous with said locking flap 116, thereby forming an acute angle with the annular side section 104 of the cap 100.

Where the cap 100 is fabricated from a flexible, elastic material (e.g. HDPE plastic, LDPE plastic or PP plastic), this will cause the mobile portion 114 of the locking flange to rotate towards the disc-shaped top section 102 as well. The cap 100 is provided with notches 118. By bringing flexibility for the removal of the cap, the notches 118 reduce stress concentrations at the intersection of the locking flap 116 and the annular side section 104, reducing the likelihood of cracking and tearing. The notches 118 play the role of mechanical frontier between the mobile portion of the locking flange and the non-mobile portion of the cap (the immobile portion 112, rim 110).

Thanks to the notches 118, there is a functional separation of the mobile parts—mobile portion 114, locking flap 116 . . . —and the non-mobile parts—the immobile portion 112, rim 110 . . . —of the cap 100.

In the present case, the notches have the shape of a horse's saddle which still allows to bring flexibility to the non-mobile parts when the cap 100 is removed from the container.

Caps such as the cap 100 depicted here are thus ideal for fabrication by injection moulding or other such processes which can produce relatively complex shapes quickly and inexpensively.

FIG. 1B shows the cap 100 from above. The cap 100 is provided with a partially frangible tab 120, which is moulded integrally with the cap 100 and connected therewith by frangible sprues or bridges 122 to the locking flap 116 and by a thin wall forming a hinge 124 to the annular side wall 104. In the present embodiment the frangible bridges 122 and the thin wall 124 are made of plastic (same material as the cap) and are made integral with the cap. The frangible bridges 122 and the thin wall 124 are disposed substantially parallel respectively with the locking flap 116 and the annular side wall 104. This causes the tab 120 to block the motion of the locking flap 116, holding it in the locked first position as shown here in FIG. 1B.

To open the container, the user must snap off the tab 120 by grasping it and deflecting it so as to snap the frangible bridges 122 and rotate the hinge 124 to have the tab 120 fading out and lying against the annular side wall 104 (the final position will be presented and described in connection with FIGS. 4A & 4B). To facilitate this manipulation, the tab 120 is here provided with ridges 126, which improve the user's grip upon the tab 120.

Other way of snapping off the tab can be envisaged, for example, a vertical upwards movement on the locking flap 116 has the effect of breaking the bridges 122 and the hinge 124 can then rotate to allow taking off the cap 100 from the container neck.

The tab 120 is, as here, preferably configured such that the cap 100 cannot be removed from the container to which it is attached without the tab 120 being removed first. In this way, the tab 120 serves as a tamper-evident device, in that any tampering with the container will be immediately noticeable to the consumer in the form of a damaged or missing tab 120.

Thus, the configuration of the tab 120, the frangible bridges 122 and hinge 124, in particular the force required to break and/or shear said frangible bridges 122 and rotate hinge 124, may be adapted to the product contained within the container, and/or the profile of the consumer for which the product is destined.

Of course, it should be understood that in other embodiments there may be provided multiple tabs, or tabs in a different configuration than that which is depicted in FIG. 1B. It may be particularly advantageous to mould words or images into the tab, or provide the tab in some other configuration which is adapted to the particular application in which it is employed.

The proposed solution allows advantageously the tab 120 to remain attached to the annual side section 104 thanks to the hinge 124. As the tab 120 remains attached, it cannot be detached and "lost" in the environment. This is very important from a sustainability and recycling point of view.

As mentioned the complete cap 100 comprising among other top section 102, annular side section 104, locking flap 116, tab 120 and hinge 124 is made in one piece from one material. Said material may be a thermoplastic polymer such as HDPE plastic, LDPE plastic or PP plastic.

Along with the description of FIGS. 1A & 1B, FIG. 1C shows the cap 100 having top section 102 and annular side section 104. Annular side section 104 comprises annular portion 105 as gripping means in the process of capping the container with the cap 100. As clearly conceivable by the skilled person, the design, shape and proportions of annular portion 105 can modified as long as it keeps the specific disclosed function. The cap 100 is further provided with a locking flap 116 mobile between a locked first position and an unlocked second position wherein the locking flap 116 is rotated towards the disc-shaped top section 102 in order to move from the locked first position to the unlocked second position. As already presented the cap 100 is provided with a partially frangible tab 120, which is moulded integrally with the cap 100. The tab 120 allows blocking the motion of the locking flap 116, holding it in the locked first position and act therefore as tamper evidence means for the consumer. As clearly shown in FIG. 1C, tab 120 is attached perpendicularly to the annular side section 104 and locking flap 116. In the present case, the main axis of tab 120 is positioned vertically with respect to the positioning presented in FIG. 1C and along the longitudinal axis of an upright container to which the cap is attached. The angle between the hinge 124 of the tab 120 (not visible in FIG. 1C) and the vertical axis is null.

Figure 2A:
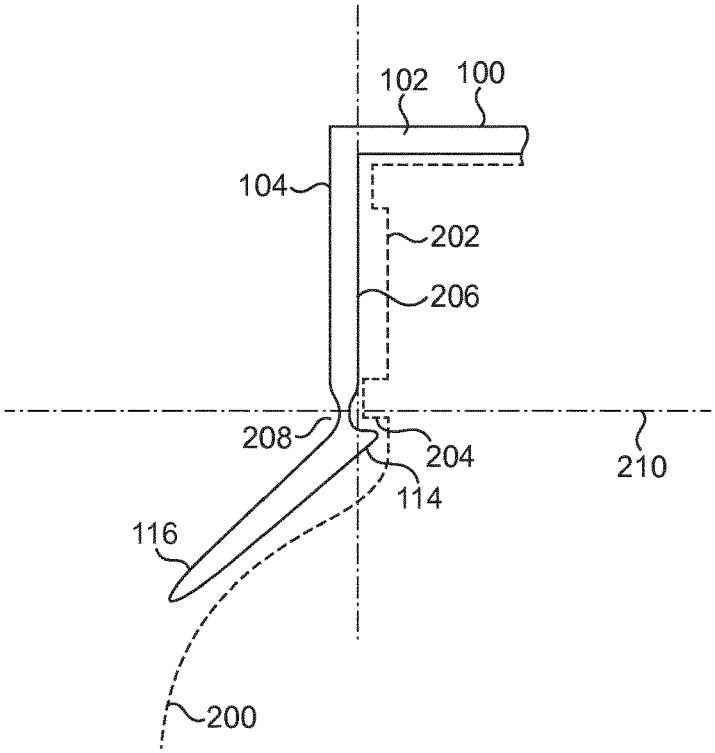
FIGS. 2A & 2B are partial cross-sectional views of the cap of FIGS. 1A, 1B & 1C, in a locked and unlocked position, respectively, without the tamper evidence means.
Figure 2B:
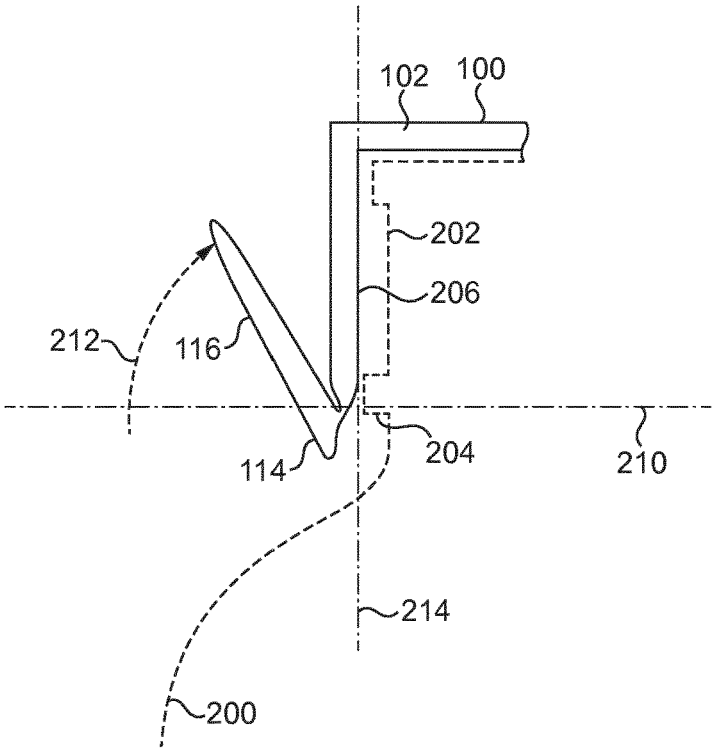

FIGS. 2A & 2B depict the cap 100 with the locking flap 116 in a locked first position and an unlocked second position, respectively. For ease of understanding of the way the cap 100 is working, the tamper evidence means comprising the tab 120 with bridges 122 and hinge 124 are not represented. In FIG. 2A, the cap 100 is depicted as disposed upon a container 200 (depicted here in schematic form) at a neck 202 thereof. The container 200 is fabricated from a preform (not shown), which is furnished with a shoulder 204 against which the mobile portion 114 of the locking flange is brought into abutment. The shoulder 204 extends about the entire circumference of the neck 202 of the container, so that the cap 100 need not be placed in any particular orientation when being attached to the container 200.

The cap 100 is retained upon the neck 202 of the container 200 by the interaction of the locking flange 111 with the shoulder 204, in particular where the mobile portion 114 of the locking flange 111 projects beyond an interior face 206 of the annular side section 104 and prevents the cap 100 from being removed from the container 200.

It should be noted that, while the shoulder 204 is here in the form of a bead of square cross-section which encircles the neck 202 of the container 200, other configurations may be more appropriate for other embodiments of the invention. For instance, the shoulder may comprise the uppermost face of a channel which is cut or moulded into the neck of the container, or it may comprise the underside of a ring or bead which encircles the neck. The actual form of the shoulder, as with the form of the cap and its constituent components, should thus be considered to be at least partially a function of the application in which the cap and corresponding container is to be employed.

It is also evident in FIG. 2A that the locking flap 116 is fabricated integrally with the cap 100, in that the locking flap 116 is joined to the annular side section 104 at a hinge 208. The hinge 208 is, in this embodiment, merely a localized reduction in the thickness of the plastic used to fabricate the cap 100, and as such makes the locking flap 116 mobile with respect to the annular side section 104 while simplifying the fabrication of the cap 100.

Furthermore, in this embodiment the locking flap 116 is provided in the form of a segment of a hollow conic frustum. Thus, given that the hinge 208 is located at the root of the locking flap 116 where it extends from the annular side section 104 along a constant, circular-segment curve, the locking flap 116 will be bistable about a plane 210, which extends through the hinge 208 parallel with the disc-shaped top section 102 of the cap 100.

In other words, the locking flap 116 will naturally put itself into either the locked first position shown in FIGS. 1A, 1B, and 2A, or the unlocked second position shown in FIG. 2B (discussed below).

It should also be noted that, owing to the positioning of the hinge 208, the locking flap 116 will serve to act as a lever when it is operated. This multiplies the force that is brought to bear by the mobile portion 114 of the locking flange against the shoulder 204, thereby increasing the strength with which the cap 100 is attached to the container 200 and the resistance of the seal between the two.

FIG. 2B depicts the cap 100 and the container 200 when the locking flap 116 is disposed in the unlocked second position. The locking flap 116 has been rotated upwards along a path 212, resulting in the mobile portion 114 of the locking flange rotating outwards away from the shoulder 204.

In the present embodiment depicted here in FIGS. 2A & 2B, the locked first and the unlocked second position are substantially symmetric about the plane 210, which thus comprises the centre point of the bistable motion of the locking flap 116. However, other configurations of the motion of the locking flap, in particular the configuration of the locked first and unlocked second positions relative to the rest of the cap, may vary as a function of the application.

Returning to the present embodiment, as a result of the displacement of the locking flap 116 into the second unlocked position, the mobile portion 114 of the locking flange is in a position which is recessed relative to the interior surface 206 of the annular side section 104. This is illustrated here in FIG. 2B by an imaginary surface 214, which is an extension of the interior surface 206 of the annular side section 104; the mobile portion 114 of the locking flange is positioned so as not to intersect the imaginary surface 214.

With the mobile portion 114 of the locking flange so positioned, the cap 100 can now be easily withdrawn from the neck 202 of the container 200, as the mobile portion 104 of the locking flange can no longer come into contact with the shoulder 204.

Figure 3:
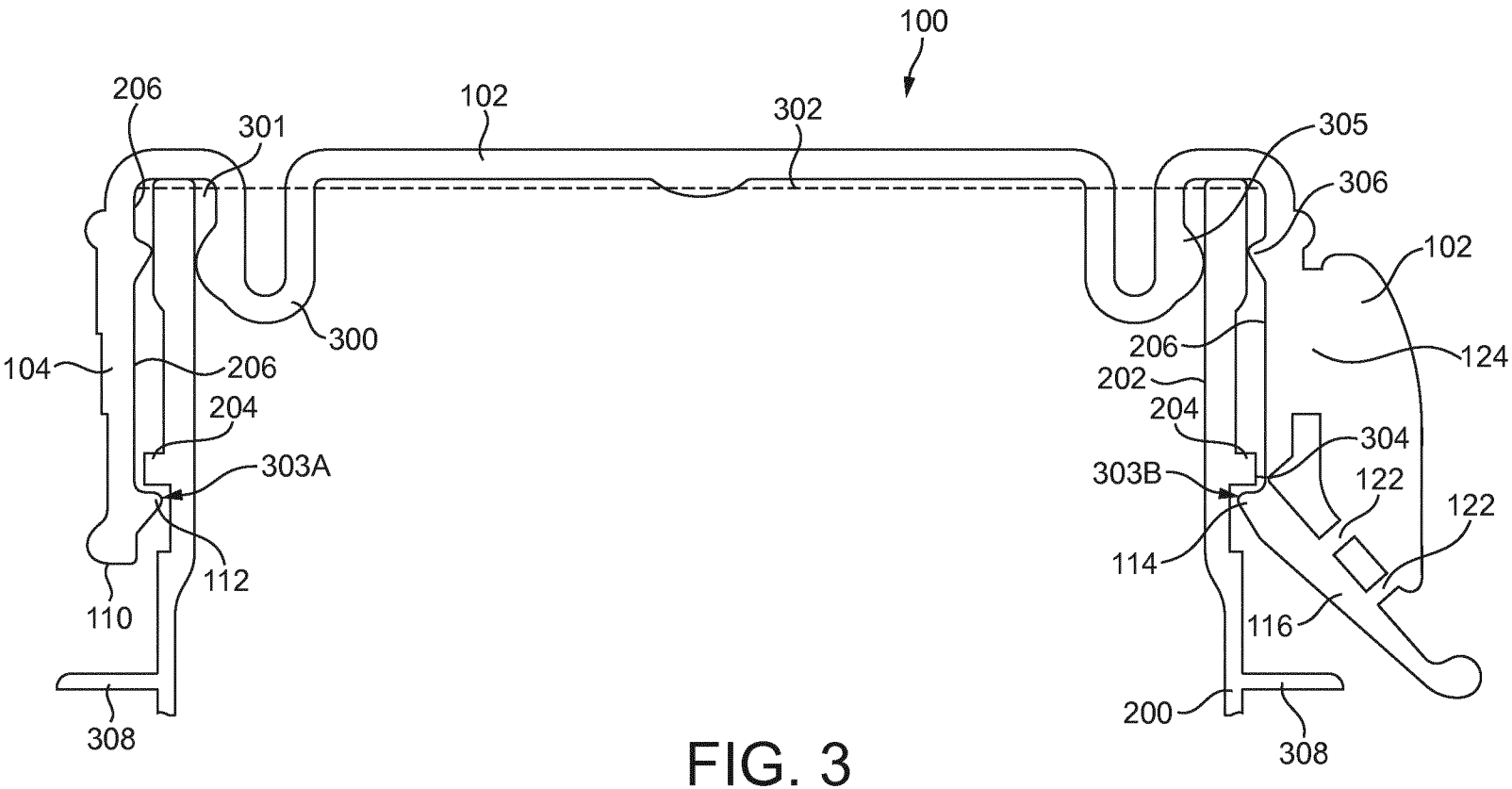
FIG. 3 is a cross-sectional view of the cap of FIGS. 1A & 1B.

FIG. 3 depicts the cap 100, which is provided with a sealing ring 300 which extends from the disc-shaped top section 102 towards the rim 110, extending coaxially within the annular side section 104. The sealing ring 300, in cooperation with the interior surface 206 of the cap 100, forms an annular notch 301 which is configured to accommodate the mouth 302 of a container 200 therein.

Thus, in the present embodiment as depicted here in FIG. 3, when the cap 100 is attached to the container 200, the neck 202 lodges in the annular notch 301, creating an interference fit therewith. This further augments the quality of the seal between the cap 100 and the container 200, and prevents the accidental dislodgement of the cap 100 when the locking flap 116 is disposed in the unlocked second position as discussed above.

In FIG. 3 it is illustrated how the cap 100 engages the container 200 to lock itself thereto. The part of the immobile portion 112 of the locking flange nearest the disc-shaped top portion 102 of the cap 100 is the locking face 303A, which is disposed substantially perpendicularly with the interior surface 206 of the cap 100. When the cap 100 is disposed upon the container 200, the locking face 303A will abut the shoulder 204, preventing the cap 100 from being withdrawn from the container 200.

Likewise, the mobile portion 114 of the locking flange comprises a locking face 303B. As the mobile portion 114 of the locking flange rotates with the locking flap 116, the angle that the locking face 303B forms with respect to the interior surface 206 of the cap 100 will vary.

Thus, when the locking flap 116 is disposed in the locked first position, as illustrated in FIG. 3, the locking surface 303B will project substantially perpendicularly from the interior surface 206, such that it will come into abutment with the shoulder 204 and prevent the cap 100 from being removed from the container 200. Conversely, when the locking flap 116 is rotated into the unlocked second position, the locking surface 303B will be disposed so that it no longer engages the shoulder 204. In such a disposition, the mobile portion 114 of the locking flange is recessed relative to the interior surface 206, with the locking surface 303B being at least substantially parallel and continuous with the interior surface 206, if not extending outwardly from it.

Moreover, in the case where the cap 100 is not fully pressed down onto the container 200 prior to moving the flap 116 into the locked first position, the motion of the locking surface 303B of the mobile portion 114 of the locking flange will serve to lever the cap 100 into the proper position.

Specifically, the locking surface 303B will bear against an edge 304 of the shoulder 204, such that as the locking flap 116 is rotated into the locked first position, it will exert a force on the container 200 that will cause the cap 100 to be further tightened against the container 200, and then retaining the cap 100 in place once the locking flap 116 is fully disposed in the locked first position. The locking flap 116 will thus multiply the efforts of the user, fixing the cap 100 to the container 200 with a maximum of force and, consequently, a high-integrity seal.

Both the sealing ring 300 and the interior surface 206 of the annular side section 104 are further provided, respectively, with sealing beads 305, 306, which extend over the entire circumference of the sealing ring 300 and the interior surface 206. The sealing beads 305, 306 serve to concentrate the force of the interference fit exerted upon the neck 202, further improving the strength of the seal between the cap 100 and the container 200.

It may be particularly desirable for the neck 202 to comprise a local increase of the thickness of the neck 202 of the container 200 near the mouth 302, as depicted here. This serves as a reinforcement of the mouth 302, offering improved strength to the container 200. Also, the amount of material used to fabricate the container 200 may be reduced, while maintaining a tight seal between the mouth 302 and the sealing beads 305, 306.

It should also be noted that the forms (i.e. cross-sectional profiles) of the sealing beads 305, 306 that are depicted here are merely exemplary. It will be readily understood that, in any particular embodiment, the sealing beads will be configured according to the application in which the cap is to be employed and according to the desired effect they are intended to have.

In this embodiment, the sealing ring 300 is substantially circular in form. However, in other embodiments it may be preferable to provide a sealing ring in a non-circular form, for instance projecting from the disc-shaped top portion 102 along an oval or elliptical curve. Such a form will, in certain applications, help to bring the cap 100 into alignment with the neck 202 of the container when the two are not aligned with each other. In any case, the sealing beads 305, 306 will be substantially circular, in that they will comprise local variations in size to compensate for local deviations in the radius of the sealing ring 300 and achieve correct sealing with the container 200.

Furthermore, in this embodiment the cap is fabricated such that it is of a substantially constant thickness, resulting in a U-shaped profile for the sealing ring 300. This is advantageous in that it facilitates the moulding of the cap 100; however, in other embodiments it may be preferable to provide the sealing ring 300 as a simple projection from the disc-shaped top section of the cap rather than as a folded curve as seen in this embodiment. The exact configuration may be chosen with respect to the application in which the cap is to be employed.

The design of the sealing ring 300 of the cap 100 may be optimized to allow a good contact force with the neck 202 of the container 200 while still keeping the ability to be folded during opening.

In addition, the locking flap 116 is provided with a tab 120 forming tamper evidence means. The tab 120 is connected to the locking flap 116 via frangible bridges 122 and a hinge 124. When the locking flap 116 is first manipulated, the frangible bridges 122 breaks and the force applied to the locking flap 116 push on the tab 120 leading hinge 124 to rotate so that the tab 120 fades out and lies against the annular side wall 104. The final position of the tab 120 clearly indicates to the consumer that the cap has first been opened. As presented in this embodiment, the main axis of tab 120 is positioned vertically with respect to the presented figure along the longitudinal axis of an upright container to which the cap is attached.

Finally, it should be noted that the container 200 is provided with a support ring 308. The support ring 308 permits the manipulation of the container 200, particularly during a blow-moulding process in which a preform is expanded into the container 200, but also generally during the filling and sealing of the container 200. In this embodiment the support ring 308 is provided separately from the shoulder 204; however, it may be advantageous in other embodiments that the locking flange engages the support ring directly.

Moreover, when the locking flap 116 is disposed in the locked first position, it will extend over the support ring 308 so as to at least partially cover it, giving the container 200 a generally streamlined form and preventing the support ring 308 from being caught on anything when the container 200 is manipulated or transported.

Figure 4A:
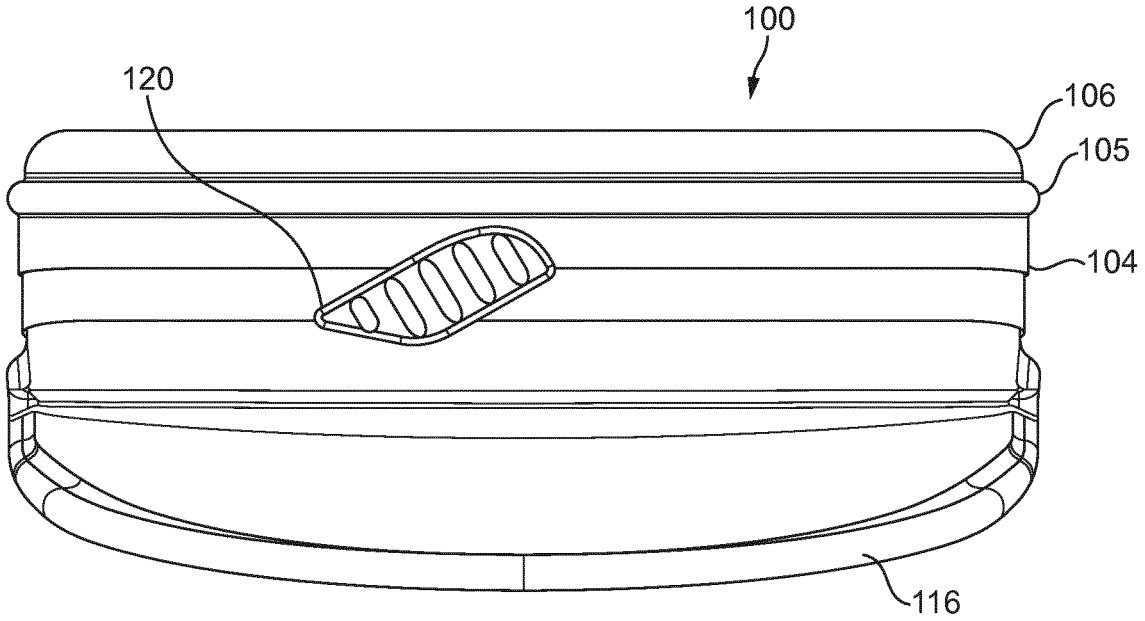
FIGS. 4A, 4B & 4C are respectively front and top perspective views of the cap of FIGS. 1A, 1B & 1C after the tamper evidence member has been manipulated in the first locked and second unlocked position.
Figure 4B:
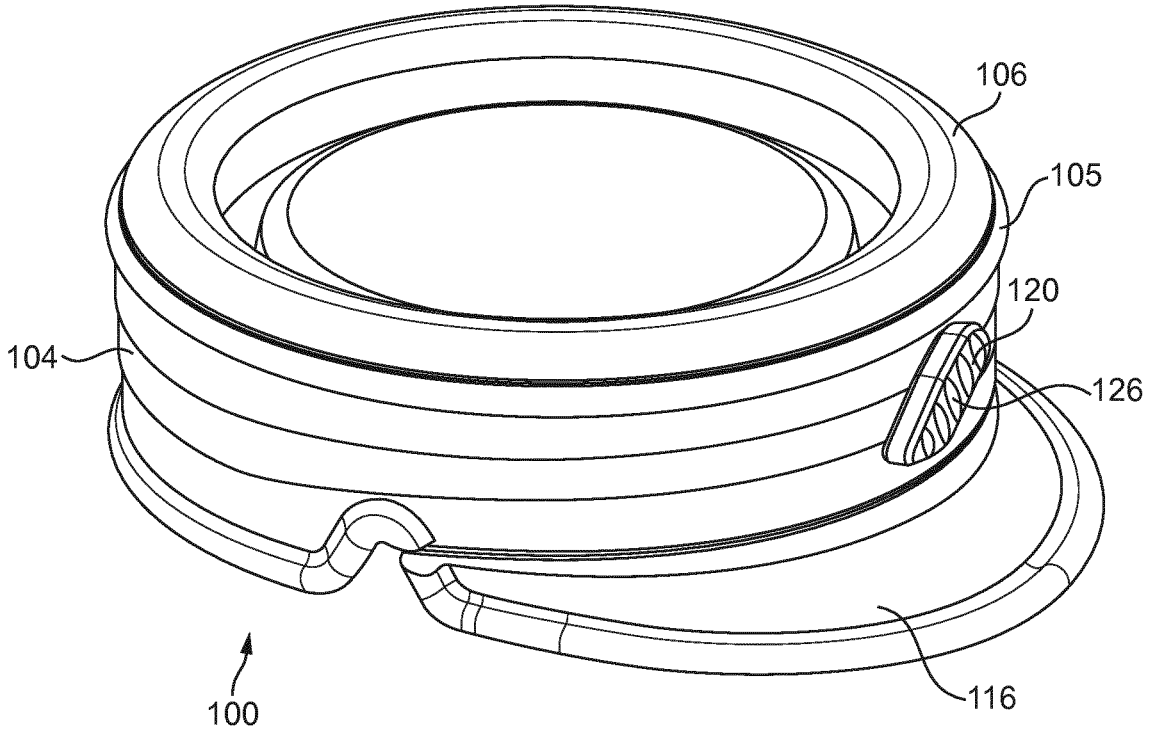
Figure 4C:
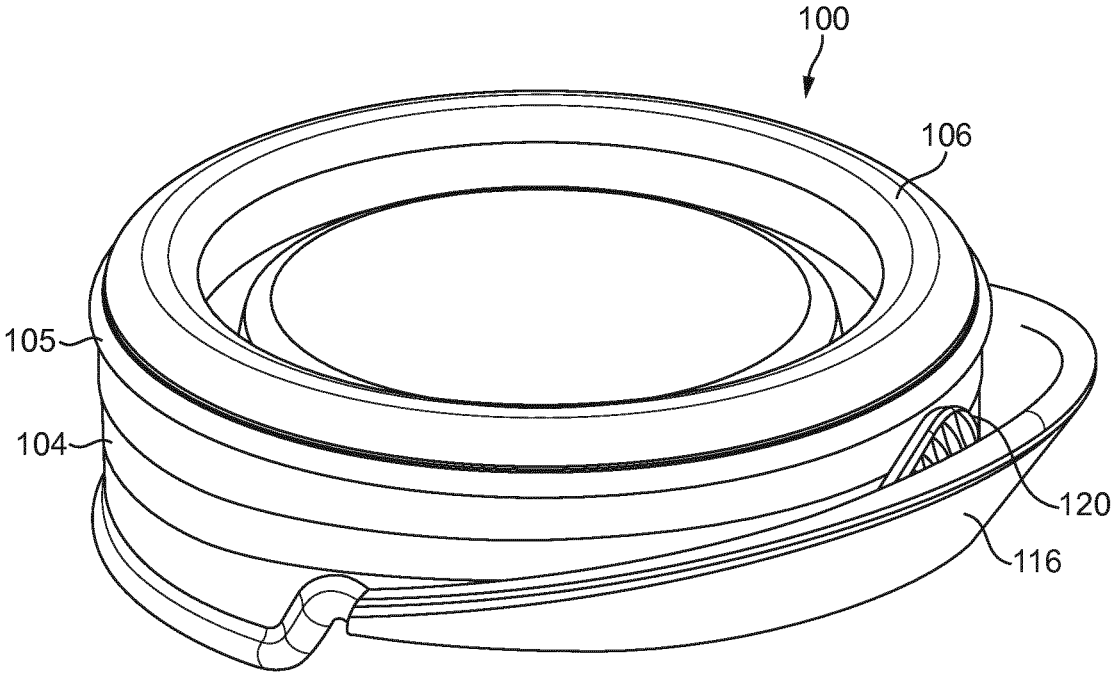

FIGS. 4A, 4B & 4C are respectively front and top perspective views of the cap of FIGS. 1A, 1B & 1C after the tab forming tamper evidence means has been manipulated in the first locked position and second unlocked position.

FIGS. 4A & 4B are front and perspective views of cap 100 after tab 120 has been moved by grasping tab 120 and deflecting it so as to snap the frangible bridges 122 and rotate the hinge 124 to have the tab 120 fading out and lying against the annular side wall 104. In more details, during this movement, tab 120 begins to deform, slides on the left (or right) side until complete rupture of the bridges 122 and then the hinge 124 pivots vertically and is twisted on the left (or right) side according to the direction that tab 120 will take.

Due to the fact that the rotation axis of hinge 124 is vertical (perpendicular to annular side section 104 and locking flap 116), hinge can rotate towards the right direction or towards the left direction.

The fact that once manipulated, the axis of the tab 120 appears shifted from the vertical axis of hinge 124 is due to the fact that before hinge 124 rotates, the consumer snaps the frangible bridges and tab deforms thereby twisting the hinge on one of the sides.

Thanks to hinge 124 being non frangible contrary to bridges 122, the tab remains connected to the annular side section 104 of cap 100.

In the current position, the locking flap 116 is in the first locked position and the cap 100 cannot be removed from the container's neck.

FIG. 4C shows perspective view of cap 100 in the second unlocked position in which the cap can be removed from the container's neck. One can see on FIG. 4C the final position of the tab 120 after it has been manipulated and after the locking flap 116 has been moved from the first locked position to the second unlocked position.

The proposed tamper evidence means is particularly advantageous in that once manipulated, it does not interfere with the locking flap 116 allowing for opening the cap 100. Indeed, the locking flap 116 can be moved from the first locked position to the second unlocked position without any difficulties as the tab 120 accommodates itself within the free space between the annular side section 104 and the locking flap 116 in the second unlocked position.

Figure 5A:
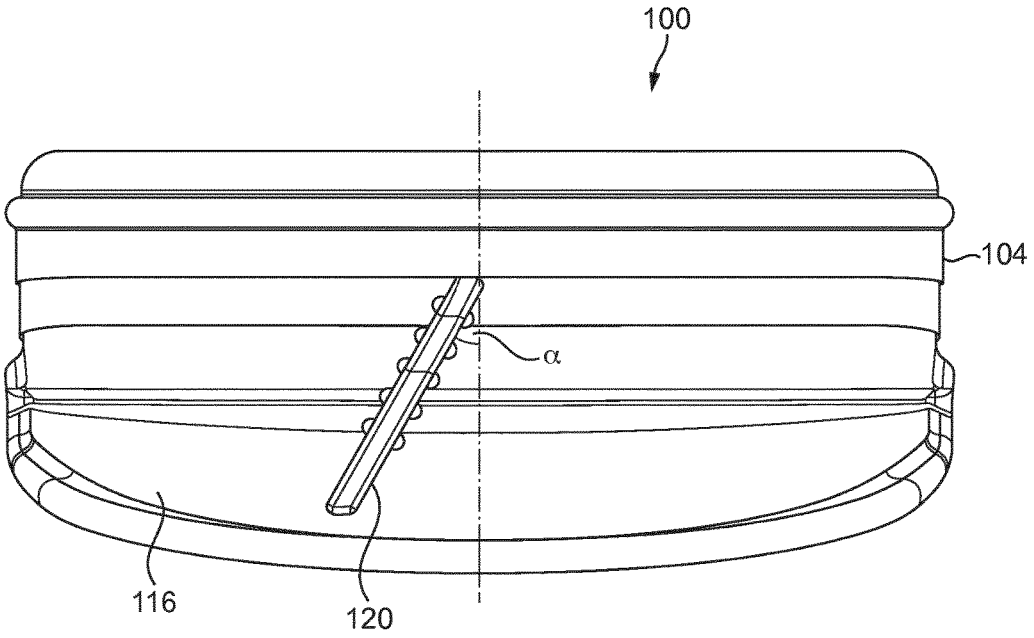
FIGS. 5A, 5B & 5C are respectively front, side and top perspective views, of a cap according to a second embodiment of the invention in the locked position.
Figure 5B:
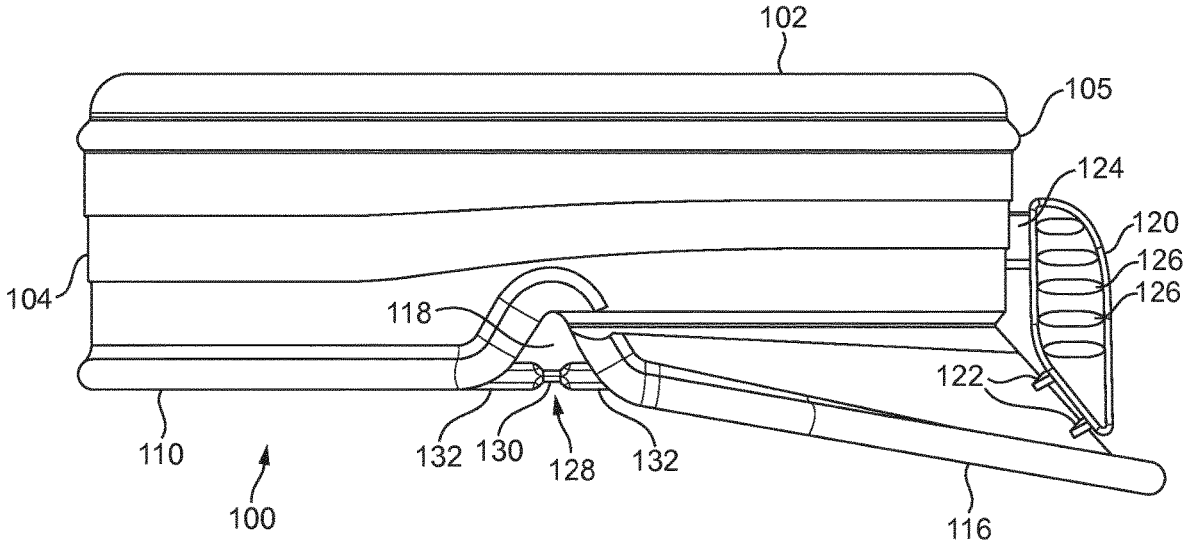
Figure 5C:
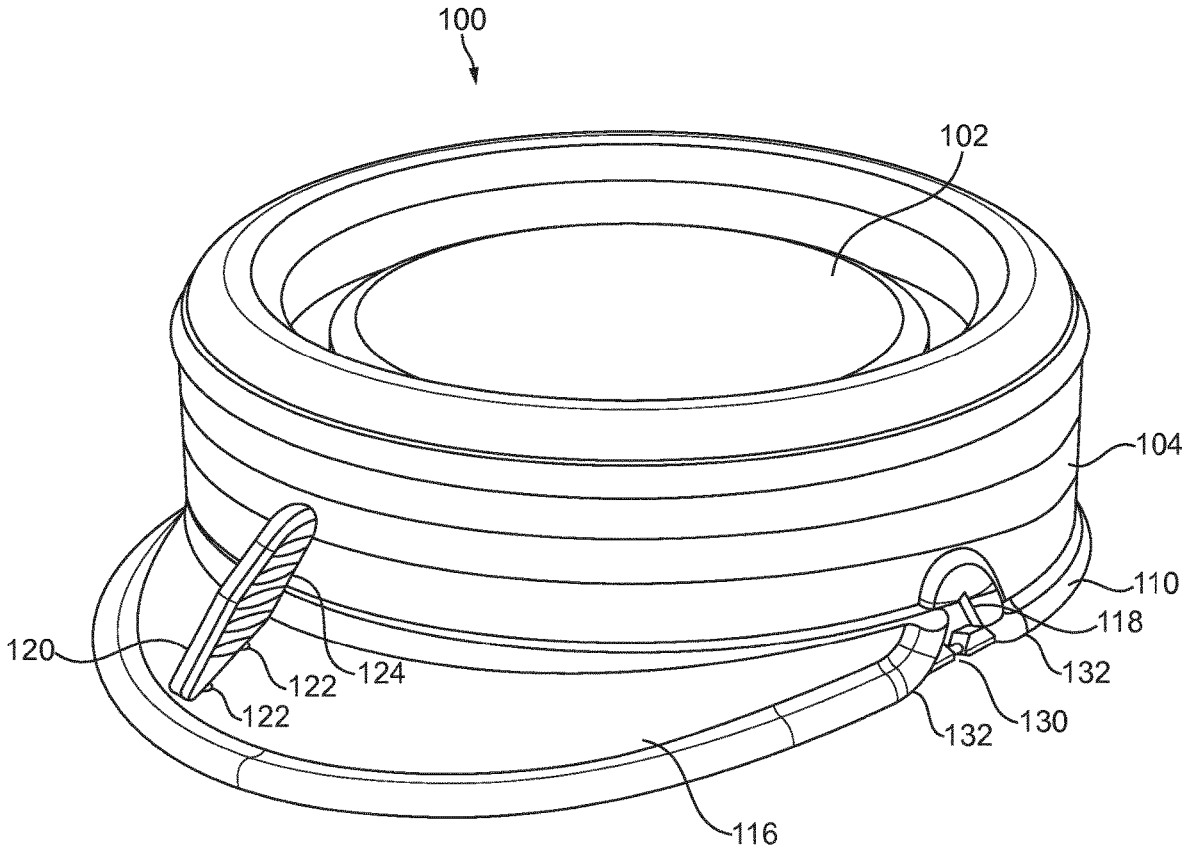

FIGS. 5A, 5B & 5C respectively represent front, side and top perspective views, of a cap according to a second embodiment of the invention in the locked position.

The referenced number already used in connection with FIGS. 1A to 1 C will be used for the same referring elements.

In this second embodiment of the invention, the tab 120 has a different positioning than the tab of the first embodiment. As can be seen from FIGS. 5A to 5C, the hinge 124 of tab 120 is not positioned vertically but inclined with respect to the vertical axis defined as the direction of the annular side section 104 projecting substantially perpendicularly from the perimeter of the disc-shaped top section 102.

As can been seen from FIGS. 5A and 5C, the hinge 124 is inclined with respect to the vertical axis. Preferably, the hinge 124 is inclined from an angle $\alpha$ of about 20 to 60° with respect to the represented vertical axis. In the presented embodiment, the hinge 124 is inclined from about 45° with respect to the vertical axis. The proposed hinge inclination of 45° is optimal as the consumer can handle break the tab 120 and remove the cap with one hand.

In addition to the proposed tamper evidence means using a partially frangible tab 120, it is presented in this second embodiment additional tamper evidence means as second tamper evidence means for the consumer to be able to identify if the container/bottle has already been opened and the cap removed or manipulated.

The proposed second tamper evidence means can be used on the different embodiments of the present invention alone or in combination with the proposed first tamper evidence means already described using partially frangible tap 120.

As already disclosed in FIGS. 1A to 1C, the notches 118 located between the mobile portion of the locking flange 111 and the non-mobile portion of the cap 100 (the immobile portion 112, rim 110) play the role of mechanical frontier between these two portions of the cap 100.

This specific location is used to implement second tamper evidence means as any movement of the locking flap 116 will cause a change in the conformation of this notches 118.

Second tamper evidence means 128 represented on FIGS. 5B and 5C are located between the internal edges 132 of the notches 118 creating a connection 132 between the two internal edges 132 of the notches 118.

This connection 132 is conformed as a plastic bridge connection between the two opposite internal edges 132 of the notches 118. It is made from the same material as the cap 100 and is integral with the cap.

The connection 132 is a plastic bridge of about XX width between the edges 132 of the notches 118.

These second tamper evidence means 128 are positioned on both sides of the cap at each location of the notches 118.

Thus, when the locking flap 116 of cap 100 is first moved from the first locked position to the second locked position, in addition to the breakage of the bridges 122 of the tab 120, the connection 130 between the two internal edges 132 of the notches 118 is broken indicating that the cap has been manipulated for opening.

During breakage of connection 130, sole the plastic bridge connection breaks and the remaining plastic portions remains attached to the internal edges 132 of the notches 118. No plastic element is removed or scattered over nature.

These second tamper evidence means 128 also allows reinforcing the positioning of the cap on the neck of the container during phases of the supply chain (transportation, storage . . . ).

As can be seen from these figures in comparison with FIGS. 1A to 1C, is that the length of the locking flap 116 may vary. In the present case, the length of the locking flap 116 of FIGS. 1A to 1C is longer than the one of FIGS. 5A to 5C. This has no effect on the way the proposed tamper evidence means globally work but the length of the locking flap 116 may vary during the conception of the cap according to the type of movement and/or force to be applied on the locking flap.

Figure 6A:
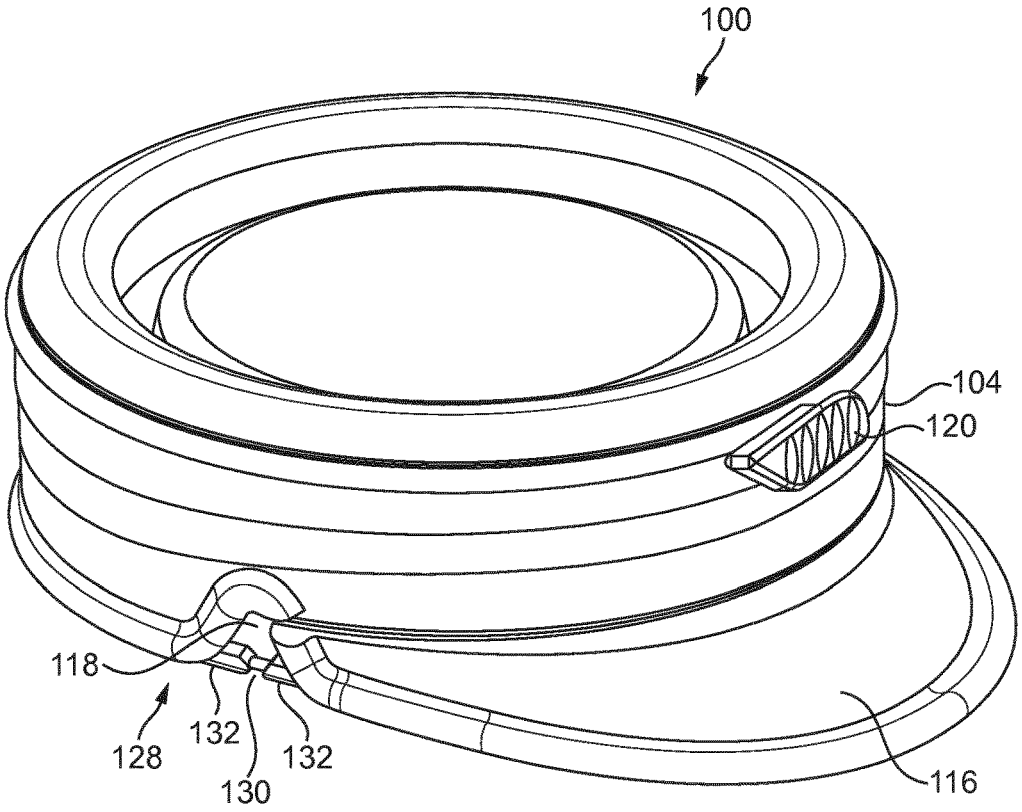
FIGS. 6A & 6B are views of the cap of FIGS. 5A, 5B & 5C in the locked first and unlocked second position, after the tamper evidence member has been manipulated.
Figure 6B:
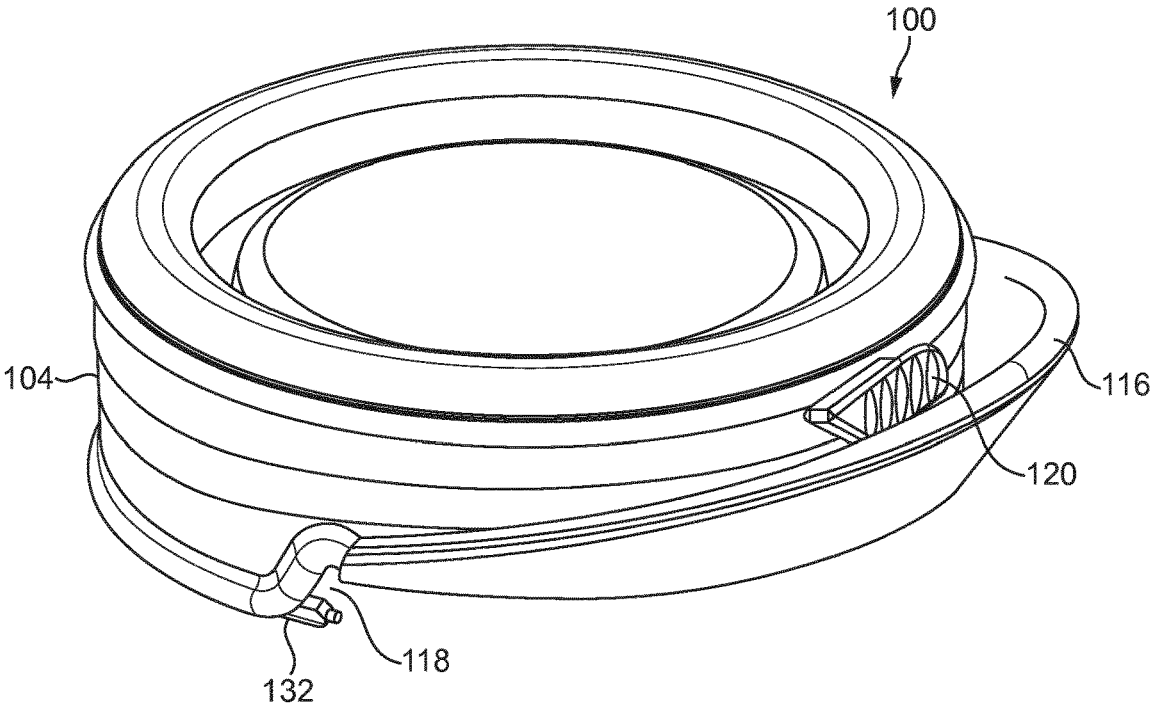

FIGS. 6A & 6B represent views of the cap of FIGS. 5A, 5B & 5C in the locked first and unlocked second position, after the tamper evidence member 120 has been manipulated.

In this second embodiment, when the tab 120 is pressed, it begins to deform and slides until the bridges 122 are broken, the hinge 124 rotates around this specific angle. Due to the specific hinge angle, there is no twisting of the hinge during this movement and the tab 120 fades out and lies against the annular side wall 104. Thus, there is not interaction between tab 120 and the locking flap 116 when the locking flap 116 is further moved from the first locked position to the second unlocked position.

As can be seen on FIG. 6A, the second tamper evidence means 128 are still in functional (with their tamper evidence function) when the tab 120 has been manipulated and the locking flap 116 in the first locked position.

From FIG. 6B, it can been seen that the second tamper evidence means 128 break when the locking flap 116 is first handled from the first locked position to the second unlocked position. The plastic bridge connection of connection 130 is broken leaving the notches 118 fully functional.

It will be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

The invention claimed is:

1. A cap for a container, comprising:

a disc-shaped top section extending generally in a horizontal plane;

an annular side section projecting substantially perpendicularly from the perimeter of the disc-shaped top section along a vertical axis to an extremity defining a rim portion;

a locking flange disposed at an extremity of said annular side section opposite the disc-shaped top section, and comprising an immobile portion and a mobile portion;

a locking flap extending from at least a portion of the rim portion of the annular side section and being mobile between, a locked first position wherein the mobile portion of the locking flange contiguous with the locking flap extends inwardly from an interior face of the annular side section, and an unlocked second position in which the mobile portion of said locking flange is at least partially recessed relative to said interior face of the annular side section, and first tamper evident member comprising tamper evidence member attached to the annular side section and to the locking flap, the locking flap being thereby immobilized in the locked first position when the tamper evidence member is in place defining thereby its functional position, the tamper evident member is partially frangible when the cap is first opened allowing the locking flap to reach the unlocked second position and in that the tamper evidence member remains attached to one of annular side section or locking flap after the cap is first opened.

2. The cap according to claim 1, wherein the tamper evident member is a partially frangible tab.

3. The cap according to claim 2, wherein the partially frangible tab comprises a first part attached to one of annular side section or locking flap that is frangible and a second part respectively attached to one of locking flap or annular side section that is not frangible.

4. The cap according to claim 3, wherein the second part remains attached to one of locking flap or annular side section when the cap is first opened leading the locking flap to reach the unlocked second position.

5. The cap according to claim 3, wherein the tab is integral with the cap.

6. The cap according to claim 3, wherein the first part of the tab that is frangible comprises at least one frangible bridge.

7. The cap according to claim 6 wherein the at least one frangible bridge is attached to the locking flap.

8. The cap according to claim 6 wherein the hinge is connected to the annular side section.

9. The cap according to claim 8, wherein the hinge is inclined with respect to the vertical axis defined as the direction of the annular side section projecting substantially perpendicularly from the perimeter of the disc-shaped top section.

10. The cap according to claim 9, wherein the hinge is inclined from 20 to 60° with respect to the vertical axis.

11. The cap according to any of claim 3, wherein the second part of the tab that is not frangible is a hinge.

12. The cap according to claim 1, comprising notches located at the lateral intersection of the locking flap and the annular side section and a second tamper evidence member located between two opposite internal edges of the notches.

13. The cap according to claim 12 wherein the second tamper evidence member comprises a connection conformed as a plastic bridge connection that breaks when the locking flap is moved from the first locked position to the second unlocked position.

14. A package comprising: a cap for a container, comprising a disc-shaped top section extending generally in a horizontal plane, an annular side section projecting substantially perpendicularly from the perimeter of the disc-shaped top section along a vertical axis to an extremity defining a rim portion, a locking flange disposed at an extremity of said annular side section opposite the disc-shaped top section, and comprising an immobile portion and a mobile portion, a locking flap extending from at least a portion of the rim portion of the annular side section and being mobile between, a locked first position wherein the mobile portion of the locking flange contiguous with the locking flap extends inwardly from an interior face of the annular side section, an unlocked second position in which the mobile portion of said locking flange is at least partially recessed relative to said interior face of the annular side section, first tamper evident member comprising tamper evidence member attached to the annular side section and to the locking flap, the locking flap being thereby immobilized in the locked first position when the tamper evidence member is in place defining thereby its functional position, the tamper evident member is partially frangible when the cap is first opened allowing the locking flap to reach the unlocked second position and in that the tamper evidence member remains attached to one of annular side section or locking flap after the cap is first opened; and a container comprising a mouth provided with a neck having a shoulder, the cap being located upon the mouth of the container such that the locking flange of the cap engages the shoulder of the neck of the container.

* * * * *